US007267146B2

(12) United States Patent
Olofsson

(10) Patent No.: US 7,267,146 B2
(45) Date of Patent: Sep. 11, 2007

(54) CHIPPER BED KNIFE

(75) Inventor: Anders Olofsson, Domsjö (SE)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 11/256,835

(22) Filed: Oct. 24, 2005

(65) Prior Publication Data

US 2006/0086420 A1 Apr. 27, 2006

Related U.S. Application Data

(63) Continuation-in-part of application No. PCT/FI2004/050024, filed on Mar. 8, 2004.

(30) Foreign Application Priority Data

Apr. 24, 2003 (FI) ..... 20035051

(51) Int. Cl.
*B27C 7/00* (2006.01)

(52) U.S. Cl. ..... 144/176; 144/162.1; 241/242; 241/296

(58) Field of Classification Search ..... 144/162.1, 144/172, 174, 176, 218, 230; 241/92, 242
See application file for complete search history.

(56) References Cited

U.S. PATENT DOCUMENTS

| | | | | |
|---|---|---|---|---|
| 3,220,447 | A * | 11/1965 | Marquez | 29/401.1 |
| 4,969,605 | A | 11/1990 | Morin | |
| 5,139,063 | A * | 8/1992 | Nettles et al. | 144/176 |
| 5,236,024 | A * | 8/1993 | Svensson et al. | 144/176 |
| 5,655,582 | A * | 8/1997 | Morin | 144/176 |
| 6,027,055 | A | 2/2000 | Doskocil | |
| 6,120,373 | A | 9/2000 | Schrattenecker | |
| 6,290,154 | B1 * | 9/2001 | Yoshida et al. | 241/65 |
| 6,484,770 | B1 | 11/2002 | Jonkka | |

FOREIGN PATENT DOCUMENTS

| | | |
|---|---|---|
| CH | CL 37741 | 7/1907 |
| DE | 34 40 455 A1 | 5/1986 |
| DE | 195 21 190 A1 | 1/1997 |
| FI | 32299 B | 1/1962 |
| FI | 86973 C | 7/1992 |
| FI | 99099 C | 6/1997 |

* cited by examiner

*Primary Examiner*—Shelley M. Self
(74) *Attorney, Agent, or Firm*—Alix, Yale & Ristas, LLP

(57) ABSTRACT

The invention relates to a chipper (1) bed knife (2) attached detachably to the chipper frame (3), the chipper (1) having a chipper disc (5) supported on its shaft (4), which shaft is fitted rotatably to the chipper frame (3), the chipper disc (5) comprising a number of knives (6) arranged to pass the knife edge (7) of the bed knife (2) at a distance corresponding to the required knife clearance (v), when the chipper disc (5) is rotating. The bed knife (2) also has a second knife edge (7'), the said knife edges (7, 7') being arranged at a distance from each other in the direction of movement (A) of the chipper disc (5) knives (6). A groove (8) is formed in the bed knife (2) between the said knife edges (7, 7').

14 Claims, 3 Drawing Sheets

CHIPPER BED KNIFE

CROSS REFERENCE TO RELATED APPLICATIONS

This application is a Continuation-in-Part of International Application No. PCT/FI2004/050024, filed Mar. 8, 2004, designating the US and claims the benefit under 35 U.S.C. §119 of Finnish Patent Application No. 20035051, filed Apr. 24, 2003.

BACKGROUND OF THE INVENTION

The invention relates to a chipper bed knife that is selectively detachably to the chipper frame, the chipper having a chipper disc supported on its shaft, which shaft is fitted rotatably to the chipper frame.

Such a chipper disc is comprised of a number of knives arranged to pass the knife edge of the bed knife at a distance corresponding to the required knife clearance, when the chipper disc is rotating. When logs are chipped, very thin and long strips are sometimes cut off. This is due to the properties of wood. The outermost layer of a debarked log is often difficult to cut, as a result of which the said long strips are produced. Such wood strips pass through between the chipper disc and bed knife without being cut, thus causing problems at chip screens, conveyors and other equipment.

SUMMARY OF THE INVENTION

The object of the invention is to provide a bed knife by means of which the wood strips can be cut to such a length that they will not cause problems in the further processing of the chips.

This object is achieved by means of the bed knife according to the invention, which is characterised in that the bed knife also has a second knife edge, the knife edges being arranged at a distance from each other in the direction of movement of the chipper disc knives, and that a groove is formed in the bed knife between the knife edges.

In the solution according to the invention, the wood strips passing the first knife edge of the bed knife are caught in the groove between the knife edges of the bed knife and cut into short pieces by the second knife edge.

The bed knife can be one solid piece or, alternatively, of two or more pieces joined together. The bed knife according to the invention can thus easily replace a conventional bed knife.

The second knife edge is preferably formed by providing a groove in the bed knife. The groove can be made either by ordinary machining or by composing the bed knife of pieces.

The knife edges of a bed knife are preferably parallel to each other. The bed knife can be dimensioned in such a way that the knife clearance is equal at both knife edges.

For most chippers, the minimum size of the groove in the bed knife is 5×5 mm. The larger the groove size, the better the long wood strips are caught in the groove and cut into shorter pieces. In practice, the maximum size of the groove is limited by the size of the bed knife.

The bed knife may be fitted in a log chipper, which chips logs and may also be used in a re-chipper for cutting chips that have been already chipped at least once.

BRIEF DESCRIPTION OF THE DRAWINGS

The invention is described in greater detail in the following, with reference to the accompanying drawings, in which.

DETAILED DESCRIPTION

Figure 1:
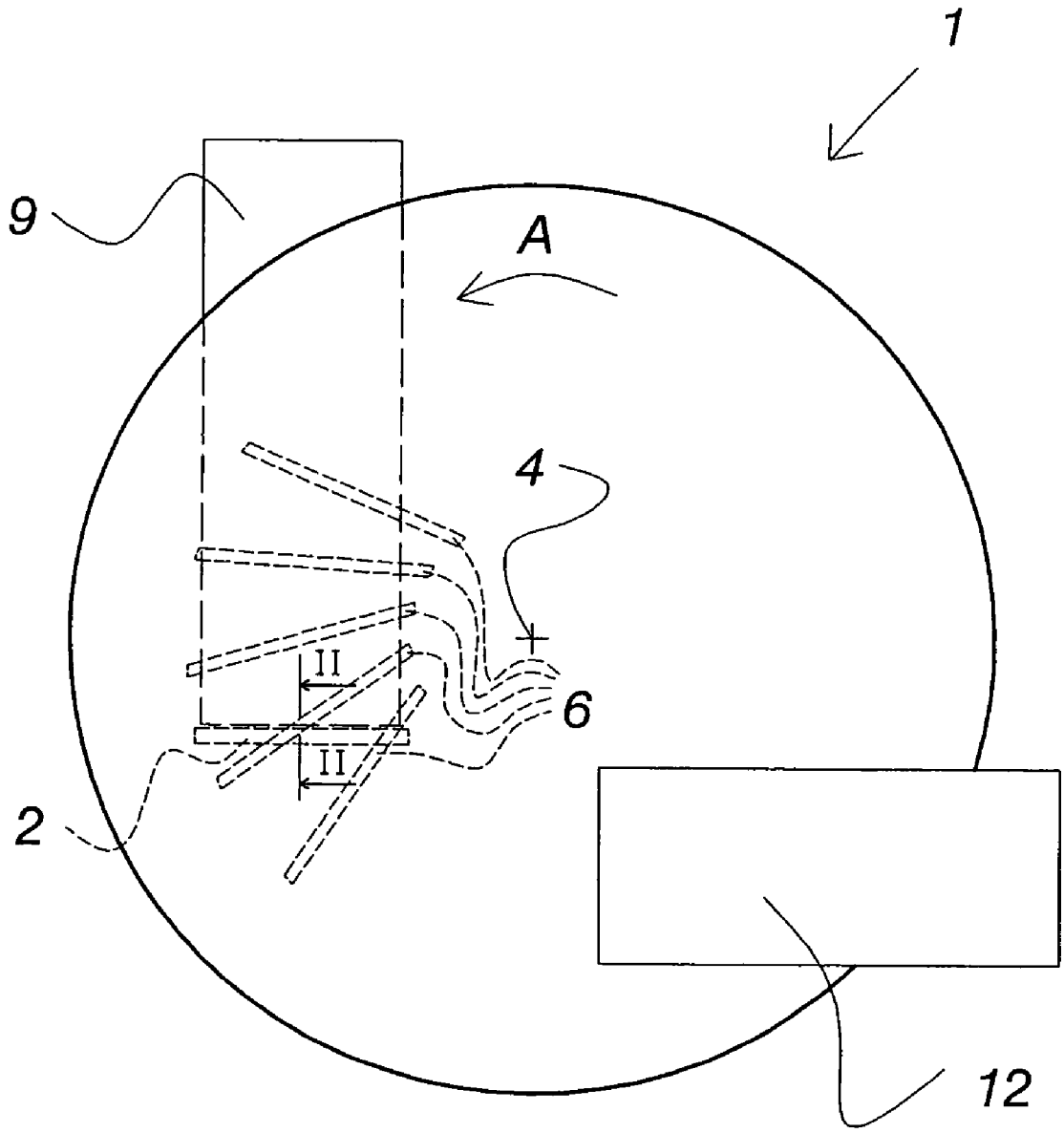
FIG. 1 shows a disc chipper as a schematic end view.

A disc chipper 1 is generally used when producing wood chips for the needs of the pulp and paper industry, a schematic example of which is shown in FIG. 1. The wood is chipped by knives 6 fitted to the chipper disc 5 usually slightly deviating from the radial direction. For the sake of clarity, however, only a few of these knives 6 are presented in FIG. 1. The knives 6 of the chipper disc 5 hit the log to be chipped, which leans against the bed knife 2 on its opposite side. The bed knife 2 is fitted to the end of the log infeed chute 9.

The bed knife 2 of the chipper 1 is attached to the chipper 1 frame 3 detachably, for example, by means of bolts 10. The chipper disc 5 is supported on its shaft 4, which shaft is fitted rotatably to the frame 3. The chipper disc 5 comprises a number of knives 6, which are arranged to pass the knife edge 7 of the bed knife 2 at a distance corresponding to the required knife clearance v, when the chipper disc 5 is rotating in the direction of the arrow A.

The chips cut by the knife 6 pass via the chip slot 11 through the chipper disc 5 and further to the discharge opening 12 of the chipper 1.

When logs are chipped, very thin and long wood strips are sometimes cut from them due to the properties of wood. Such strips cause problems in the further processing of chips. In order to eliminate such problems, a second knife edge 7' is provided on the bed knife 2. The knife edges 7, 7' are arranged at a distance from each other in the direction of movement A of the knives 6 of the chipper disc 5. The knife edges 7, 7' are most preferably arranged in such a way that the knife clearance v is equal at both knife edges. In the bed knife 2 is, in addition, provided a groove 8 between the said knife edges 7, 7' which has dimensions of a depth (a), a height (b), and a length. The preferred size a×b of the groove 8 is 5×5 mm. The function of the groove 8 is to receive long wood strips, whereby when caught in the groove 8, they are cut into short pieces when the knife 6 passes the knife edge 7'. The groove 8 functions best when it is as large as possible. The size of the bed knife 2 determines the maximum size of the groove 8.

Figure 2:
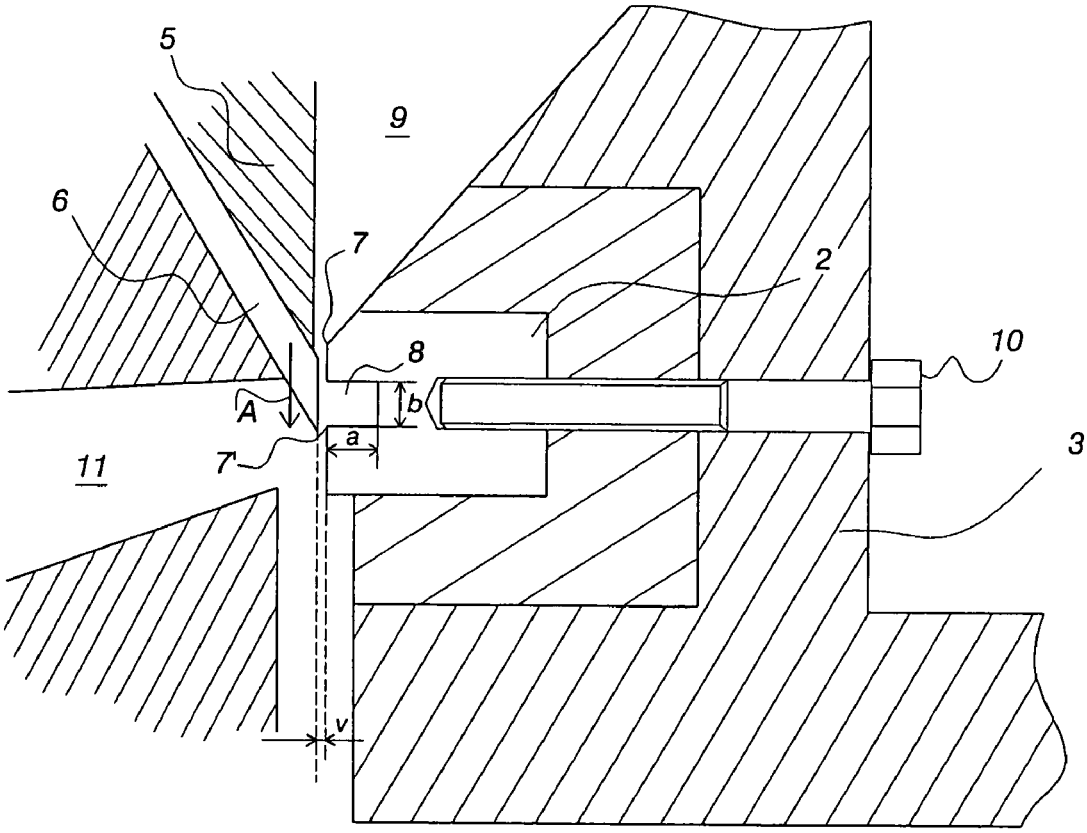
FIG. 2 shows a section along line II-II in FIG. 1.

In the example of FIG. 2, the knife edge 7' has been formed by cutting a groove 8 in the bed knife 2. The knife edge 7' and its groove 8 on the side of the knife edge 7 may obviously also be accomplished in another way, for example by composing the bed knife 2 of suitable pieces.

Figure 3:
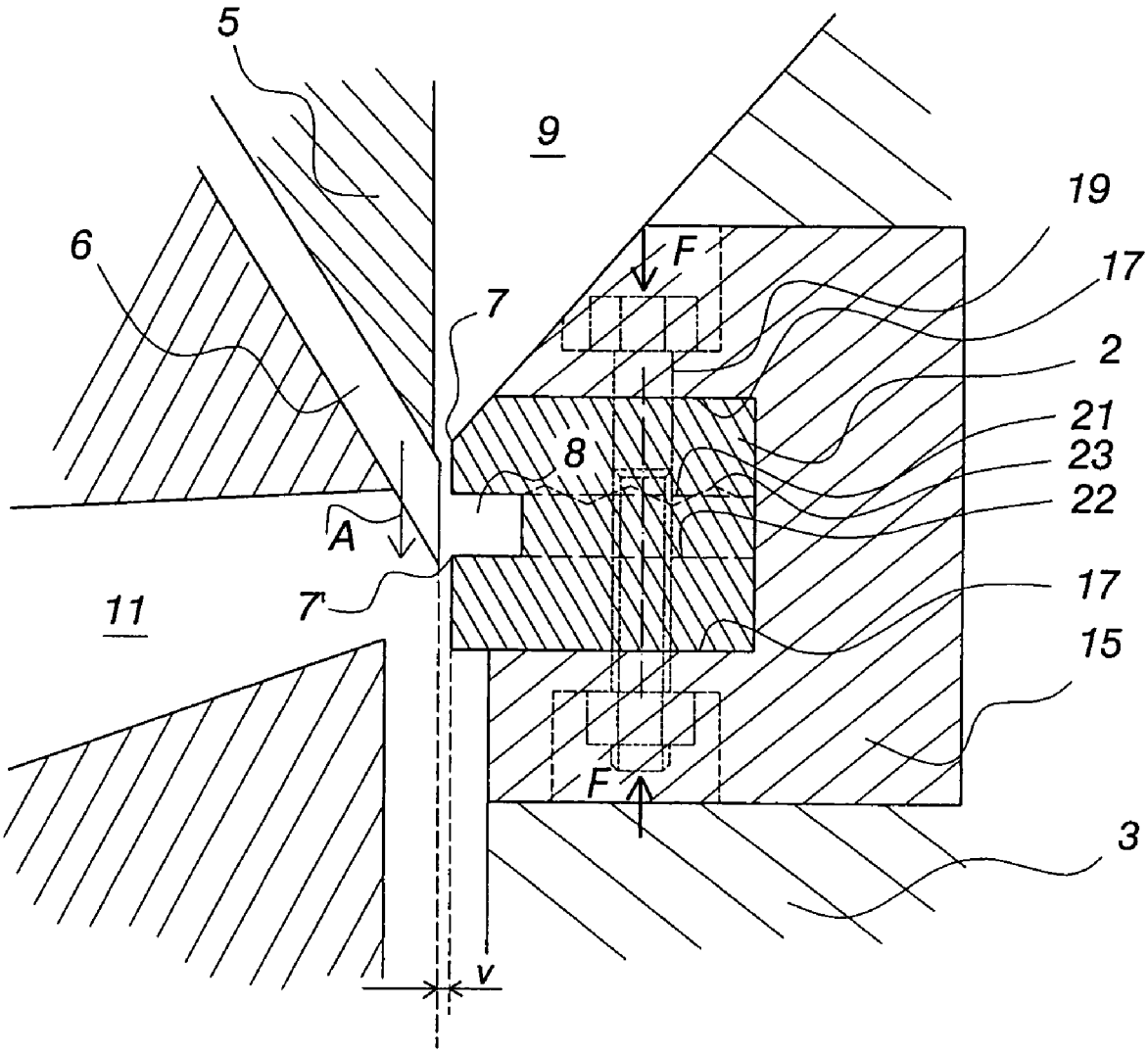
FIG. 3 shows another embodiment of the invention also in the section along line II-II in FIG. 1.

In the example of FIG. 2, the bed knife 2 consists of one solid piece. As shown in FIG. 3, the bed knife 2 may, however, also be made of two or more pieces, which are joined together preferably detachably to facilitate the handling of the bed knife 2. The separate pieces of the bed knife are preferably clamped against each other by exposing them to a compressive force through the inside walls 17 of the frame 15 according to arrows F. The clamping force can be intensified by means of setting screws or by a bolted joint 19 or other clamping or fastening means known in the art.

In FIG. 3, examples of different assemblies of the bed knife are illustrated by dashed lines 21, 22 and 23. For instance, a two-piece bed knife assembly may be represented as being divided into two parts according to line 21, 22 or 23. Accordingly, a three-piece assembly may be represented as being divided into three parts according to lines 21 and 22 or 23 and 22. Obviously, the number of separate parts of the bed knife can be even greater and such assemblies do not depart from the spirit or scope of the present invention.

The invention has been described above only with reference to a chipper, where logs are chipped. According to the present invention, however, bed knife 2 can also be used in chippers re-chipping already made chips, among which there are long wood strips that need to be cut prior to further processing of the chips.

While exemplary embodiments of the foregoing invention have been set forth for purposes of illustration, the foregoing description should not be deemed a limitation of the invention disclosed herein. Accordingly, various modifications, adaptations and alternatives may occur to one skilled in the art without departing from the spirit and the scope of the present invention.

The invention claimed is:

1. An improved bed knife for a wood chipper of the type having a frame, a bed knife detachably attached to the frame, a rotatable chipper disc having a plurality of chipper disc knives, and supported on a shaft, wherein said chipper disc rotates in a chipping direction around said shaft and is disposed opposite said bed knife at a distance corresponding to a required knife clearance (v) for chipping the wood, the improvement wherein said bed knife has at least two simultaneously deployed knife edges wherein said two knife edges are arranged at a distance relative to each other in said chipping direction and wherein said bed knife also has a groove disposed between said two knife edges.

2. The bed knife as claimed in claim 1 wherein the bed knife is one piece.

3. The bed knife as claimed in claim 1, wherein the bed knife comprises at least two pieces.

4. The bed knife as claimed in claim 1, wherein said second knife edge is formed by an edge of said groove in the bed knife.

5. The bed knife as claimed in claim 1, wherein said knife edges are substantially parallel to each other.

6. The bed knife as claimed in claim 1, wherein said knife clearance (v) is essentially equal at both knife edges.

7. The bed knife as claimed in claim 1, wherein said groove has dimensions of a depth (a) and a height (b) wherein said depth (a) is a minimum of 5 mm and said height (b) is a minimum of 5 mm.

8. The bed knife as claimed in claim 1, wherein the bed knife is arranged in a chipper for chipping logs, or alternatively in a re-chipper for cutting chips.

9. A chipper cutting assembly for chipping or rechipping wood comprising:

a frame;

a shaft;

a rotatable chipper disc mounted on said shaft and having a plurality of knives that move in a chipping direction; and a detachable bed knife attached to said frame and arranged relative to said rotatable chipper disc at a distance corresponding to a required knife clearance (v);

wherein said bed knife has at least two bed knife edges for simultaneously chipping the wood and a groove disposed between said two bed knife edges having dimensions of a depth (a) and a height (b), for receiving wood strips cut at the first knife edge and wherein said bed knife edges are arranged at a distance relative to each other in the chipping direction.

10. The chipper cutting assembly of claim 9 wherein said bed knife is one piece.

11. The chipper cutting assembly of claim 9 wherein said bed knife is comprised of at least two pieces.

12. The chipper cutting assembly of claim 9 wherein said knife edges are substantially parallel to each other.

13. The chipper cutting assembly of claim 9 wherein said knife clearance (v) is essentially equal at both knife edges.

14. The chipper cutting assembly of claim 9 wherein said groove has a minimum depth (a) of 5 mm and a minimum height (b) of 5 mm.

* * * * *